US005265535A

United States Patent [19]

Isowa et al.

[11] Patent Number: 5,265,535

[45] Date of Patent: Nov. 30, 1993

[54] PRINTING MACHINE FOR CORRUGATED BOARD SHEET

[75] Inventors: Yasuyuki Isowa, Kasugai; Takashi Hibino, Inuyama, both of Japan

[73] Assignee: Kabushiki Kaisha Isowa, Nagoya, Japan

[21] Appl. No.: 991,788

[22] Filed: Dec. 17, 1992

[30] Foreign Application Priority Data

Dec. 28, 1991 [JP] Japan ..... 3-360501
Jan. 18, 1992 [JP] Japan ..... 4-027236

[51] Int. Cl.[5] ..... B41F 31/00

[52] U.S. Cl. ..... 101/350; 101/366; 101/148

[58] Field of Search ..... 101/207, 208, 210, 350, 101/363, 364, 365, 367, 216, 219, 148

[56] References Cited

U.S. PATENT DOCUMENTS

| | | | |
|---|---|---|---|
| 1,840,069 | 1/1932 | Walker et al. | 101/350 |
| 1,993,284 | 3/1935 | Roehm | 61/350 |
| 3,587,460 | 6/1971 | Chambon | 101/350 |
| 4,603,633 | 8/1986 | Schubert | 101/366 |
| 4,667,595 | 5/1987 | Geretzki | 101/366 |
| 5,003,877 | 4/1991 | Yano et al. | 101/363 |
| 5,085,145 | 2/1992 | Ohta et al. | 101/364 |
| 5,088,407 | 2/1992 | Helm et al. | 101/363 |
| 5,134,935 | 8/1992 | Hayes et al. | 101/363 |

*Primary Examiner*—Eugene H. Eickholt

*Attorney, Agent, or Firm*—Jordan and Hamburg

[57] ABSTRACT

Disclosed is a printing machine for corrugated board sheets, which is designed to facilitate the procedures of ink change in accordance with order changes in the printing of corrugated board sheets by using a low viscosity and quick-drying glycolic ink, in which the residual ink of the previous order can effectively be recovered so as to minimize the amount of the ink to be wasted. The printing machine having a plate cylinder with a printing die mounted thereon and an impression cylinder disposed to oppose to the plate cylinder, rotatable in the different rotational directions, in which corrugated board sheets are designed to pass through the clearance between the plate cylinder and the impression cylinder to carry out printing in a predetermined pattern, the printing machine further comprising an ink transfer roll which rotates in contact with the printing die; a squeezing roll which rotates normally in contact with the ink transfer roll during operation of the printing machine to adjust the amount of the ink on the surface of the ink transfer roll; a supply unit to selectively supply a low-viscosity and highly quick-drying ink or a cleaner to the ink fountain defined between the rolls; a pair of dams to selectively open and close the both longitudinal extremities of the ink fountain; and a scraper which scrapes off the ink or the ink washing waste transferred to the roll when the scraper is brought into contact therewith.

10 Claims, 9 Drawing Sheets

PRINTING MACHINE FOR CORRUGATED BOARD SHEET

BACKGROUND OF THE INVENTION

This invention relates to a printing machine for corrugated board sheets, more particularly to a printing machine which is designed to facilitate the procedures of ink change in accordance with order changes in the printing of corrugated board sheets by using a low viscosity and highly quick-drying glycolic ink newly developed by the applicant, in which the residual ink of the previous order can effectively be recovered so as to minimize the amount of the ink to be wasted.

Generally, the conventional printing machines for corrugated board sheets can roughly be classified into two types: longitudinal feeding rotary press, as shown in FIG. 7 and flexographic press, as shown in FIG. 8, in which different structures are employed depending on the properties of the inks to be used. These two types of presses have merits and demerits which are substantially mutually contradistinctive, as will be described later.

To describe first the longitudinal feeding rotary press, "longitudinal feeding" means that the corrugated board sheet is fed to the press in the longitudinal direction which is orthogonal to the corrugation of the sheet. However, the rotary press is widely employed recently in a printer slotter in which the corrugated board sheet is fed transversely thereto to carry out printing and also slotting. In the printer slotter, a highly viscous glycolic ink is used, and the ink is transferred to printing dies mounted on a plate cylinder after the ink is milled homogeneously over a multiplicity of rubber rollers. For example, in a printer slotter consisting of a group of various kinds of rolls as shown in FIG. 7, a corrugated board sheet 16 is passed between a plate cylinder 12 having mounted thereon printing dies 10 and an impression cylinder 14 disposed to oppose to the plate cylinder 12 whereby to carry out printing in a desired pattern. Meanwhile, the ink in an ink fountain 20 is transferred through an ink fountain roll 22, an intermediate roll 24 and a series of transfer rolls 18 to the printing dies 10.

The printer slotter has merits and demerits of its own. These merits and demerits, which are basically attributable to the use of a highly viscous glycolic ink, will now be described below.

Merits:

(a) Since the ink is built up on the sheet, the printed letters or patterns are glossy.

(b) Since the ink is fed only to the necessary portions, consumption of the ink can be reduced (the ink is not circulated).

(c) When the ink is changed with another ink of a different color, the ink remaining on the rolls can be removed merely by scraping. Accordingly, the ink change operations can readily be performed in accordance with the order change, so that the printer slotter can cope with small lot printing in accordance with various types of orders. Unlike in the flexographic press to be described later, substantially no washing waste is discharged, requiring no expensive facility for treating such washing waste.

Demerits (a) Most of the currently available glycolic inks are of quick-drying type, and studies are being made recently to further improve their quickness of drying. However, compared with the flexographic printing ink to be described later, the glycolic ink still takes a considerable time for drying after printing. Accordingly, the printer slotter cannot directly be connected to a die cutter or a folder gluer in the subsequent step (b) Since the high-viscosity ink must be milled homogeneously, a number of rolls must be used for transferring the ink to make the mechanism complicated. If the rolls are worn, intricate procedures are required for adjusting the clearances between the rolls.

(c) Although the ink is transferred much to the sheet to allow printing at a high density just after the ink is supplied to the ink fountain, the ink to be transferred to the sheet is gradually reduced to allow printing at a low density as the ink is consumed. Thus, unevenness in the density of printing is liable to occur. Accordingly, an operator should constantly monitor the color density and perform intricate procedures of supplying the ink whenever the density of the ink drops.

To describe next the flexographic press, the flexographic press unlike the printer slotter uses a low-viscosity aqueous ink having a high fluidity, so that the ink dries very quickly, characteristically. For example, in the flexographic press also consisting of a group of rolls as schematically shown in FIG. 8, a corrugated board sheet 16 is passed between a plate cylinder 12 having mounted thereon printing dies 10 and an impression cylinder 14 disposed to oppose to the plate cylinder 12 whereby to carry out printing in a desired pattern. Further, an ink roll 26 and a squeezing roll 28 are rotatably disposed adjacent to the plate cylinder 12, and the ink supplied to the ink fountain defined by these two rolls 26,28 is transferred by the ink roll 26 to the printing dies 10 mounted on the plate cylinder 12. It should be noted here that the flexographic ink, unlike the one used in the printer slotter, is of highly quick-drying type, it must constantly be circulated so as to prevent drying and solidification thereof. For such purpose, a circulating mechanism is employed, as shown in FIG. 9, in which the ink contained in a tank 30 is supplied to the ink fountain defined by the rolls 26,28 via a pump 32 and a supply pipe 34, while the ink dwelling in the fountain is recovered from the ends of the rolls 26,28 to the tank 30 via a pair of dams 36 and recovery pipes 38.

Merits and demerits of the flexographic press will now be described below. These merits and demerits are also basically attributable to the properties of the ink to be used, which is of highly quick-drying and low viscosity.

Merit:

(a) The use of the quick-drying ink enables forwarding of the sheet to a die cutter or a folder gluer in the subsequent step immediately after printing.

(b) Since the ink is distributed evenly throughout the ink roll and the squeezing roll, no irregular color along the length of the rolls occurs in the printed matter. Accordingly, the operator need not constantly monitor the appearance of the printed matter.

(c) The mechanism of transferring the ink is very simple. Demerit:

(a) Since a system of constantly circulating the ink is employed, the rolls and the circulation system must be washed with a large amount of water whenever the ink is to be changed. Accordingly, it is impossible to fully recover the ink, so that a considerable amount of ink is inevitably wasted, and besides a facility for treating the washing waste must be provided in view of pollution prevention, leading to cost elevation.

(b) Since it takes some time for the ink change operation, the flexographic press is not suitable for small lot printing in accordance with various types of orders.

(c) The printed letters or patterns are less glossy than those printed in the printer slotter.

As described above, the printer slotter and the flexographic press have merits and demerits which are substantially mutually contradistinctive due to the properties of the inks to be employed respectively. The merits of the flexographic press are noted in the art, so that the printer slotter has been replaced predominantly by the flexographic press. Namely, it is because the industry recognized the merits of the flexographic press, in spite of the demerits of its own, over the printer slotter.

By the way, in recent years, the industry is urged to cope with small lot processing of corrugated board sheets in accordance with various types of orders, and this tendency is becoming conspicuous year by year. Thus, such small lot processing in the case of a printing machine means that the inks must be changed frequently within a limited time so as to cope with printing of corrugated board sheets in small lots in accordance with various types of orders. Under such circumstances, the flexographic printer is insufficiently provided for the ink change, as described in the paragraph of demerits thereof, so as to cope with the frequent order changes as the result of small lot printing. Besides, there remains a problem of treating the washing waste somehow.

It is true, as described above, that the printer slotter can suitably be employed for such small lot printing, since it requires a short ink change time, but it suffers problems in that it requires of the operator an experienced skill and intuition in order to maintain optimum appearance in the printed matters and that it takes some time for drying after printing and thus the printer slotter cannot directly be connected to the subsequent step. Accordingly, users are employing the printer slotter not always with satisfaction so as to cope with the small lot printing in accordance with various types of orders which is increasing in recent years, but merely based on the rather negative reason that it takes shorter ink change time than in the flexographic printer.

In other words, while there is an earnest potential demand of users for a printing machine which requires a reduced ink change time and thus can sufficiently cope with the small lot printing, which requires no operator for monitoring the appearance of the printed matters and which can directly be connected to the subsequent step after printing, such printing machine is not realized yet. The key to obtain a practical printing machine having the merits of both the printer slotter and flexographic press is to develop an ink which can satisfy the above-described requirements (like in the cases of the printer slotter and the flexographic press which are dependent on the properties of the inks to be employed respectively). In this regard, the applicant tackled with the improvement of the ink itself so as to meet the potential demand of the users under cooperation of an ink maker and was successful in developing a glycolic ink having quick-drying properties and a low viscosity which are almost comparable to those of the flexographic ink.

However, as the result of various tests made for the ink newly developed by the applicant, it was found that its characteristics cannot be exhibited to the maximum if they are used in the conventional printer slotter. On the other hand, although it is possible to use such ink in the flexographic press, the ink need not be circulated since the degree of low viscosity and that of quick drying are not as conspicuous as in the original flexographic ink. Accordingly, the provision of the ink circulating mechanism specific to the flexographic press becomes meaningless, and thus the press cannot cope with small lot printing since it requires washing of the mechanism, leading to waste of the ink. The inconveniences of the conventional two types of printing machines described above are very natural since they are of the structures which are designed to exhibit the characteristics of the high-viscosity glycolic ink and a low-viscosity aqueous ink to be employed therein respectively.

OBJECT AND SUMMARY OF THE INVENTION

This invention is directed to provide a practical printing machine capable of allowing the ink newly developed by the applicant to exhibit its properties to the maximum, in which the ink change in a series of operations in accordance with the changes in the printing order can speedily be carried out and the ink of the previous order remaining in the ink transfer mechanism is effectively prevented from being wasted.

In order to overcome the problems described above and attain the intended objects successfully, the printing machine for corrugated board sheets according to a first preferred embodiment of the invention has a plate cylinder with a printing die mounted thereon and an impression cylinder disposed to oppose to the plate cylinder, rotatable in the different rotational directions, in which corrugated board sheets are designed to pass through the clearance between the plate cylinder and the impression cylinder to carry out printing in a predetermined pattern; characterized in that the printing machine further comprising an ink transfer roll disposed to be approachable to the plate cylinder, which rotates in contact with the printing die mounted on the plate cylinder when it is approached to the plate cylinder; a squeezing roll which rotates normally in contact with the ink transfer roll during operation of the printing machine to squeeze the ink and adjust the amount of the ink on the surface of the ink transfer roll; a supply unit disposed above the ink transfer roll and squeezing roll to selectively supply a low-viscosity and highly quick-drying ink or a cleaner to the ink fountain defined between the rolls; a pair of dams disposed engageably with both longitudinal ends of the ink transfer roll and squeezing roll so as to selectively open and close the both longitudinal extremities of the ink fountain; and a scraper disposed engageably with respect to the squeezing roll, which scrapes off the ink or the ink washing waste transferred to the roll when the scraper is brought into contact therewith.

The printing machine for corrugated board sheets according to another preferred embodiment of the invention has a plate cylinder with a printing die mounted thereon and an impression cylinder disposed to oppose to the plate cylinder, rotatable in the different rotational directions, in which corrugated board sheets are designed to pass through the clearance between the plate cylinder and the impression cylinder to carry out printing in a predetermined pattern; characterized in that the printing machine further comprising an ink transfer roll disposed to be approachable to the plate cylinder, which rotates in contact with the printing die mounted on the plate cylinder when it is approached to the plate cylinder; an adjust member disposed adjacent to the ink transfer roll to adjust the amount of the ink on the surface of the ink transfer roll; a supply unit disposed above the ink transfer roll and adjust member to selectively supply a low-viscosity and highly quick-drying ink or a cleaner to the ink fountain defined between the roll and the adjust member; and a pair of regulating means disposed adjacent to both longitudinal ends of the ink transfer roll and adjust means so as to selectively regulate discharge of the ink or washing waste from the longitudinal extremities of the ink fountain and release such regulation thereby.

The printing machine for corrugated board sheets according to still another preferred embodiment of the invention has a plate cylinder with a printing die mounted thereon and an impression cylinder disposed to oppose to the plate cylinder, rotatable in the different rotational directions, in which corrugated board sheets are designed to pass through the clearance between the plate cylinder and the impression cylinder to carry out printing in a predetermined pattern; characterized in that the printing machine further comprising: an ink transfer roll disposed to be approachable to the plate cylinder, which rotates in contact with the printing die mounted on the plate cylinder when it is approached to the plate cylinder; a squeezing roll which rotates normally in contact with the ink transfer roll during operation of the printing machine to squeeze the ink and adjust the amount of the ink on the surface of the ink transfer roll; a supply/recovery unit disposed above the ink transfer roll and squeezing roll to be slidable parallel to the rolls , which selectively supplies a low-viscosity and highly quick-drying ink to the ink fountain defined between the rolls and recovers the residual ink in the ink fountain; and a pair of dams disposed engageably with both longitudinal ends of the ink transfer roll and squeezing roll so as to selectively open and close the both longitudinal extremities of the ink fountain.

The printing machine for corrugated board sheets according to a further preferred embodiment of the invention has a plate cylinder with a printing die mounted thereon and an impression cylinder disposed to oppose to the plate cylinder, rotatable in the different rotational directions, in which corrugated board sheets are designed to pass through the clearance between the plate cylinder and the impression cylinder to carry out printing in a predetermined pattern; characterized in that the printing machine further comprising: an ink transfer roll disposed to be approachable to the plate cylinder, which rotates in contact with the printing die mounted on the plate cylinder when it is approached to the plate cylinder; a squeezing roll which rotates normally in contact with the ink transfer roll during operation of the printing machine to squeeze the ink and adjust the amount of the ink on the surface of the ink transfer roll; a supply unit disposed above the ink transfer roll and squeezing roll to supply a low-viscosity and highly quick-drying ink to the ink fountain defined between the rolls; an a pair of regulating means disposed adjacent to both longitudinal ends of the ink transfer roll and squeezing roll so as to selectively regulate discharge of the ink or washing waste from the longitudinal extremities of the ink fountain and release such regulation thereby.

According to the thus constituted printing machine for corrugated board sheets which uses a newly developed low-viscosity and quick-drying glycolic ink, the sheets can be forwarded to the subsequent step immediately after printing, and the operator need not constantly monitor the appearance of the printed matters since no irregular color occurs. In addition, since the ink need not constantly be circulated, the structure of the mechanism can be simplified, and besides the ink can be supplied to the necessary portions of the printing die, so that the consumption of the ink can be held minimum, advantageously. Meanwhile, when the ink is to be changed in accordance with the change in the printing order, the ink adhering on the rolls can securely be removed by scraping and then washing using a very small amount of cleaner, making it possible to complete the change-over procedures in a short time, in turn, to cope with small lot printing. Further, according to the printing machine of the invention, an ink fountain is defined between the ink transfer roll and the squeezing roll, and the ink fountain is designed to be closed by the dams, so that a necessary amount of ink can be allowed to dwell therein. Accordingly, no irregular color occurs in the printed matters, and thus the operator need not constantly monitor the appearance of the printed matters. Further, an ink supply/recovery unit which is designed to be movable along the ink fountain is employed, the ink can be fed concentratedly to the desired portions of the printing die, making it possible to minimize the consumption of the ink and simplify the mechanism, since the ink need not be circulated.

Since the ink remaining in the ink fountain can be recovered by the ink supply/recovery unit in accordance with the ink change concomitant to the printing order change, the portion of the ink to be wasted can be minimized, and thus the total amount of the ink to be consumed in the printing machine can be reduced. Besides, the ink can greatly be economized, since it need not constantly be circulated, and thus only a very small amount of washing waste is discharged. In this regard, the printing machine of the invention is extremely advantageous from the standpoint of pollution prevention. In addition, neither an ink milling mechanism nor a circulating mechanism is required, realizing space saving and cost reduction.

If a tubing pump is used so as to supply and recover the ink thereby, the pump itself need not be washed for ink change, so that the amount of the ink to be wasted by washing can be reduced. Since the flexible tube can easily be detached from the pump, the tubes can easily be washed in a short time, thus reducing greatly the time required for the ink change. Meanwhile, by providing spare flexible tubes preliminarily washed, the change-over time can further be reduced.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Figure 1:
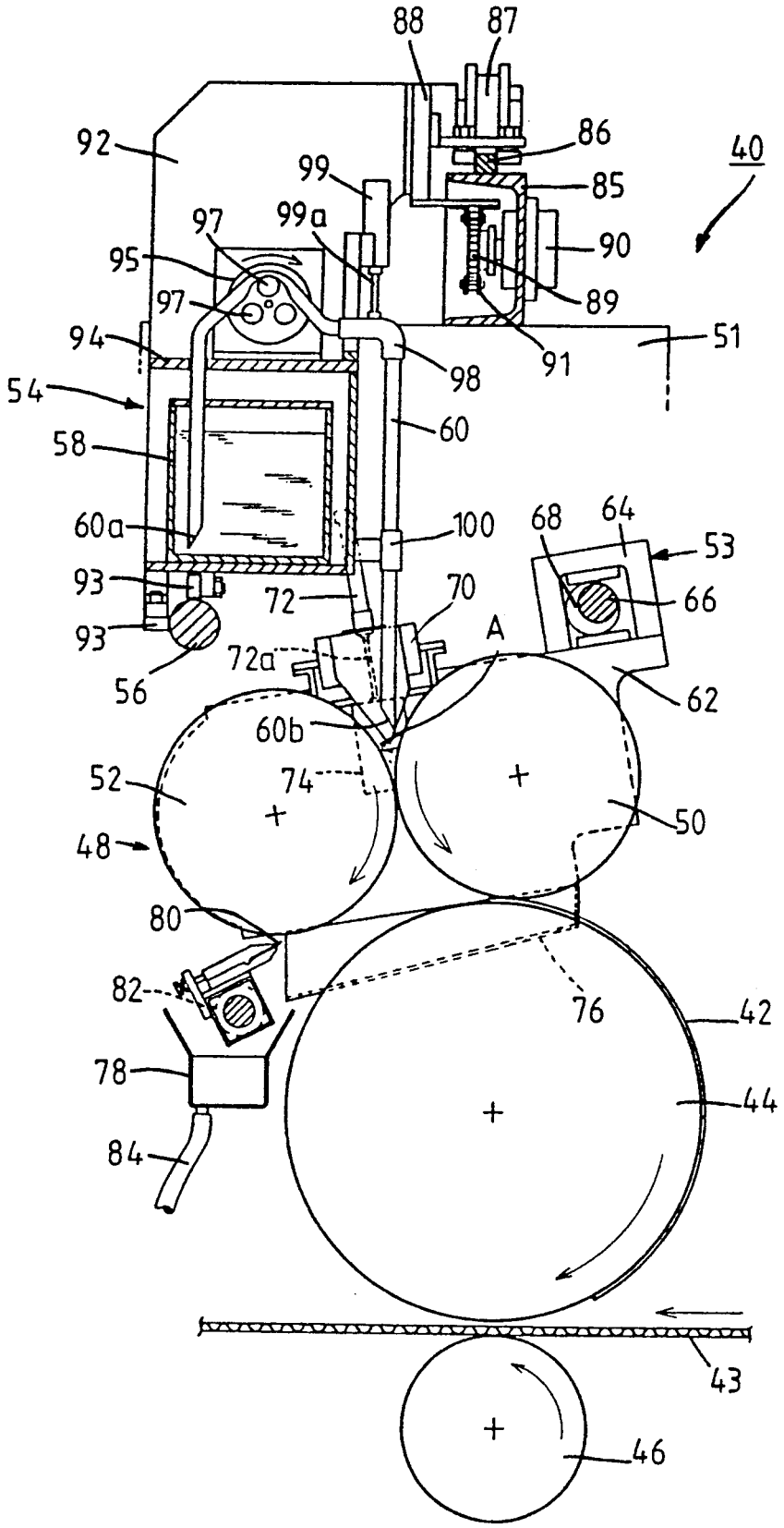
FIG. 1 shows schematically a side view of the printing machine according to one embodiment of the invention, illustrating a state where printing is being carried out onto a corrugated board sheet.
Figure 4:
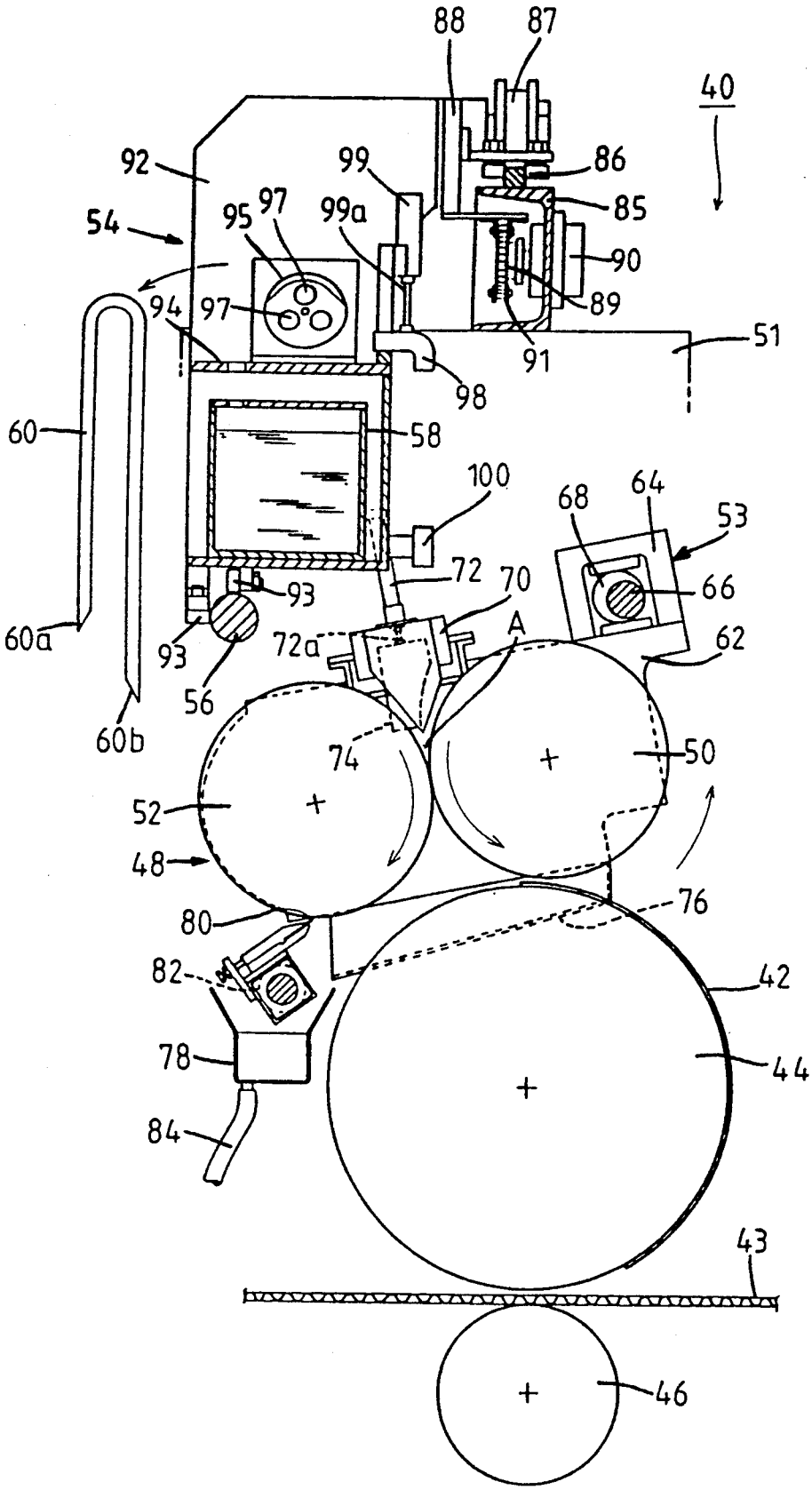
FIG. 4 shows schematically a side view of the printing machine shown in FIG. 1, illustrating a state where the residual ink in the printing machine is being washed away after completion of printing.

FIG. 1 shows schematically a side view of the printing machine according to one embodiment of the invention, illustrating a state where printing is being carried out onto a corrugated board sheet, while FIG. 4 shows schematically a side view of the same printing machine, illustrating a state where the residual ink in the printing machine is being washed away after completion of printing. The printing machine 40 shown in FIGS. 1 and 4 has, between a pair of machine frames 51 (only one machine frame is shown) spaced from each other with a predetermined distance therebetween in the direction orthogonal to the line of feeding a corrugated board sheet 43, a plate cylinder 44 on which a printing die 42 can removably be mounted and an impression cylinder 46 disposed to oppose to the plate cylinder in a vertical relationship such that the former cylinder 44 and the latter cylinder 46, which are designed to be rotatable in the different directions, may locate respectively above and below the passline of the corrugated board sheet 43.

An ink transfer mechanism 48 which transfers an ink to the printing die 42 is disposed above the plate cylinder 44. The ink transfer mechanism 48 basically consists of an ink transfer roll 50 which directly transfers the ink supplied thereto to the printing die 42, a squeezing roll 52 which is brought into press contact with the ink transfer roll 50 to squeeze the ink and adjust the amount of the ink to be transferred to the printing die 42 and a swing mechanism 53 for shifting the ink transfer roll 50 on the rotary shaft of the squeezing roll 52 within a predetermined angle. The ink transfer roll 50 can be shifted, as will be described later, by selectively operating the swing mechanism between (1) the ink transferring position, where the ink transfer roll 50 is brought into contact with the printing die 42 to allow the ink to be transferred to the printing die 42 and (2) the ink removing position, where the ink transfer roll 50 is spaced from the printing die 42 to be unable to transfer the ink to the printing die 42.

Namely, the ink transfer roll 50 is disposed to be approachable and retractable relative to the plate cylinder 44, and when the ink transfer roll 50 is approached to the plate cylinder 44, it is designed to be rotated in contact with the printing die 42 mounted on the plate cylinder 44. The ink transfer roll 50 is of an anilox roll having very fine dents formed in a desired pattern on the surface thereof, and each of these dents serves to retain a predetermined amount of ink therein as well as to prevent scattering of the ink during rotation of the rolls. While an iron containing metallic material is used for the ink transfer roll 50, it is also possible to use a metallic roll having a ceramic film formed on the surface thereof by detonation flame spraying, on which anilox is graved. Alternatively, an iron roll with no anilox (only with plating) or a simple rubber roll can also suitably be used as the ink transfer roll 50.

The squeezing roll 52 disposed adjacent to the ink transfer roll 50 is normally brought into contact with the ink transfer roll 50 during operation of the printing machine and rotated at the same speed as or a lower speed than that of the roll 50 so as to adjust the amount of the ink on the surface of the roll 50 by squeezing the excessive ink. The squeezing roll 52 is preferably of an iron containing metallic material or of a flexible material such as rubber. Incidentally, if a rubbery material is used for the squeezing roll 52, it is recommended to select the hardness thereof, for example, within the shore hardness of 50 to 75 depending on the length of the roll.

The swing mechanism 53 disposed in the ink transfer mechanism 48, including the ink transfer roll 50 and the squeezing roll 52, is designed to shift the ink transfer roll 50 on the rotary shaft of the squeezing roll 52 within a predetermined angle. Namely, a pair of brackets 62 (only one bracket is shown) are pivotally supported onto each end of the squeezing roll 52 supported rotatably between the machine frames 51, and the ink transfer roll 50 is rotatably supported on these brackets 62. A holder 64 is mounted on the upper end of each bracket 62 at a position adjacent to the ink transfer roll 50, and a pair of eccentric rings 68 fitted on a change-over shaft 66 rotatably supported between the machine frames 51 are rotatably supported by the corresponding holders 64. The change-over shaft 66 is adapted to be driven to rotate by a motor or an air cylinder not shown. Accordingly, by operating the motor or air cylinder to rotate the eccentric rings 68 by a predetermined central angle, the ink transfer roll 50 can selectively be shifted between (1) the ink transferring position, where ink transfer roll 50 is brought into contact with the printing die 42, as shown in FIG. 1, to allow the ink to be transferred to the printing die 42 and (2) the ink removing position, where the ink transfer roll 50 is spaced from the printing die 42, as shown in FIG. 4, to be unable to transfer the ink to the printing die 42. Since the mechanism for imparting rotation to the rolls 50,52 in the different directions is known per se, description on it will be omitted.

An ink fountain A is designed to be defined between the ink transfer roll 50 and the squeezing rolls 52 along the longitudinal direction thereof, when they are brought into press contact with each other. An ink supply/recovery unit 54 is disposed above the rolls 50,52, which supplies the ink to the ink fountain A and also recovers the ink remaining therein. Incidentally, if the amount of the ink supplied to the ink fountain A is too small, blurring or omission occurs in the printed matters.

Figure 2:
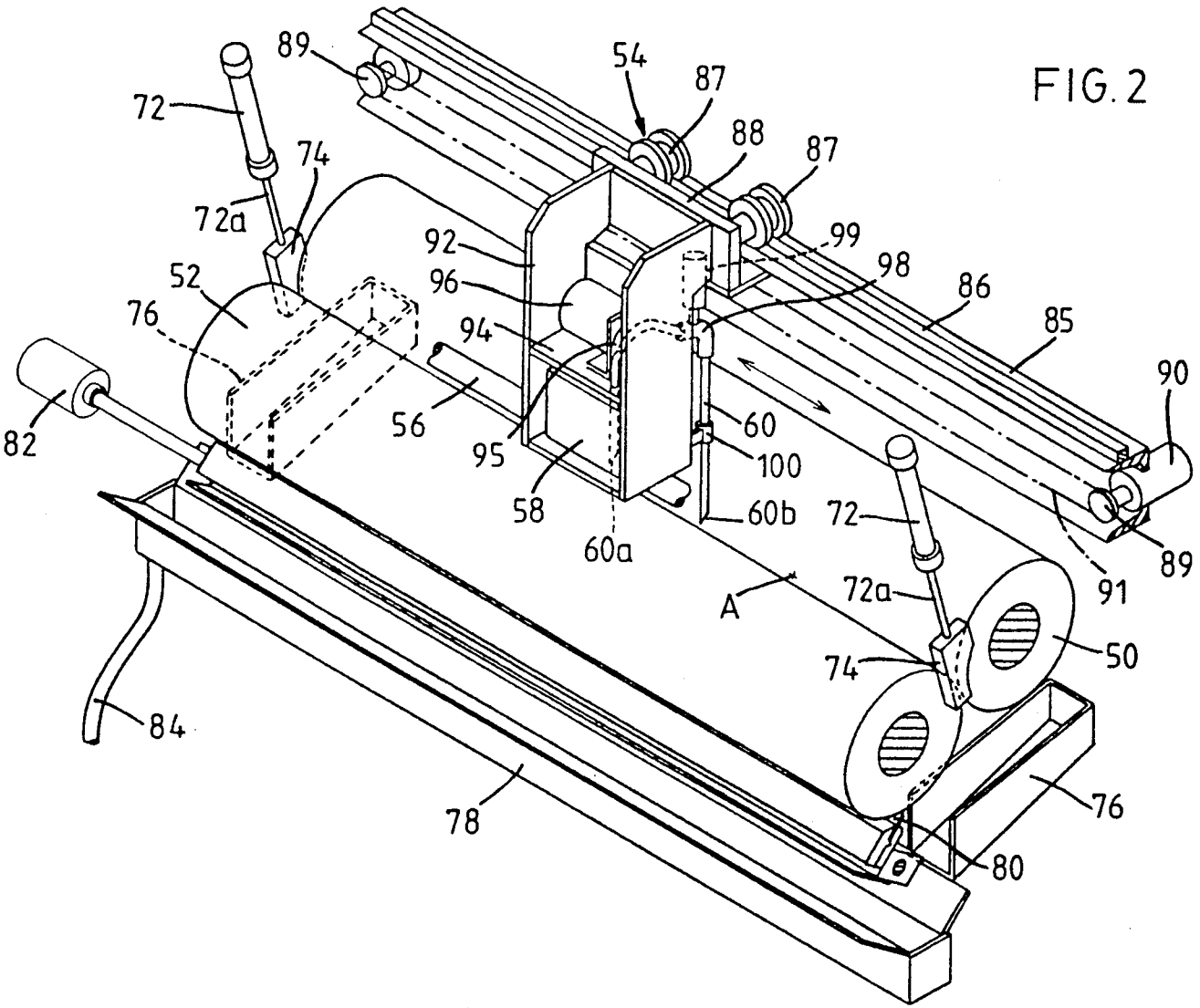
FIG. 2 shows schematically, in perspective view, the constitution of the major portion of the ink transfer mechanism and the ink supply/recovery unit of the printing machine shown in FIG. 1.

Thus, as shown in FIG. 2, the ink supply/recovery unit 54 is designed to be able to supply the ink concentratedly to the necessary portions conforming to the pattern to be printed. More specifically, a beam 85 is extended between the machine frames 51 at an upper position to be parallel to the rolls 50,52, and a carriage 88 is disposed on the guide rail 86 formed on the upper surface of the beam 85 to be slidable along the rail 86 via a pair of rollers 87. A pair of sprockets 89 are rotatably supported on the beam 85 to be spaced from each other with a predetermined distance therebetween in the longitudinal direction of the beam 85, and one sprocket 89 is designed to be rotated normally and reversely by a drive motor 90. Meanwhile, an endless chain 91 is extended across these sprockets 89 and fixed at a predetermined portion to the carriage 88. Accordingly, by actuating the drive motor 90 normally and reversely, the carriage 88 is allowed to reciprocate along the guide rail 86 as the chain 91 runs.

As shown in FIG. 2, a substantially U-shaped bracket 92 is secured to the carriage 88 to be suspended therefrom toward the squeezing roll 52, on which an ink pot 58 containing a predetermined amount of ink is adapted to be removably mounted. A support plate 94 is also fitted in the bracket 92 at a position above the ink pot 58, and a tubing pump 95 and a reversible motor 96 for driving the tubing pump 95 are disposed thereon. A flexible tube 60 is removably inserted to the tubing pump 95, and one opening 60*a* of the tube 60 is dipped in the ink contained in the ink pot 58, while the other opening 60*b* thereof locates above the ink fountain A.

The basic structure of the tubing pump 95 is known per se, in which the ink in the tube is let out in a predetermined direction by squeezing the flexible tube 60 by rollers 97 turning along a predetermined route. The ink in the flexible tube 60 is let out through the opening 60*b* by driving the reversible motor 96 normally to turn the rollers 97 of the tubing pump 95 clockwise, and thus the ink in the ink pot 58 can be supplied to the ink fountain be squeezed out through the opening 60*a* and recovered by driving the reversible motor 96 reversely to turn the rollers 97 counterclockwise.

Accordingly, the ink can concentratedly be supplied to the necessary portions of the ink fountain A by driving the reversible motor 96 normally after the carriage 88 is slid by the drive motor 90 and move the opening 60*b* of the flexible tube 60 in the axial directions of the rolls 50,52. As described above, the ink to be used in this printing machine 40 is a low-viscosity and highly quick-drying glycolic ink newly developed by the present applicant, so that it need not be circulated unlike in the flexographic press.

As shown in FIG. 1, a retainer 98 is ascendably disposed to the bracket 92, in which the portion of the flexible tube 60 extending to the right side of the tubing pump 95 is inserted to allow the opening 60*b* of the tube 60 suspended therefrom to locate at a position above the ink fountain A. An air cylinder 99 is disposed invertedly on the bracket 92, and the piston rod 99*a* of which is connected to the retainer 98, so that the level of the opening 60*b* can be shifted by operating the cylinder 99 positively or negatively. Namely, in order to carry out ink change in accordance with the order change, the opening 60*b* of the flexible tube 60 can be dipped in the ink of the previous order remaining in the ink fountain A. The ink remaining in the ink fountain A can be recovered into the ink pot 58 by driving the reversible motor 96 reversely in this state (see FIG. 3). Incidentally, the reference number 100 represents a guide which supports the lower portion of the flexible tube 60 suspended from the retainer 98 to allow the opening 60*b* to locate stably above the ink fountain A. Meanwhile, as the means for shifting the level of the opening 60*b*, an air cylinder may be disposed to the support plate 94 so that the level of the tubing pump 95 itself can be shifted by ascending or descending the support plate 94 thereby. Incidentally, a pair of guide rollers 93 are rotatably supported onto the bottom of the bracket 92, which are designed to roll being abutted against a guide 56 provided to be parallel to the rolls 50,52, as shown in FIG. 1, so as to facilitate smooth sliding of the bracket 92. A cleaner supply pipe (not shown) is disposed to the bracket 92 with its opening directing to the ink fountain A. A cleaner tank (not shown) fixed at an appropriate position is connected through a pipe (not shown) to the cleaner supply pipe, and the cleaner contained in the tank is designed to be pumped to the cleaner supply pipe with the aid of compressed air. Namely, the ink supply/recovery unit 54 is designed to slide horizontally along the guide rail 86 and supply the ink to the ink fountain A through the flexible tube 60, during operation of the printing machine, while, in order to carry out ink change in accordance with the change in the printing order, to recover the ink of the previous order remaining in the ink fountain A and supply the cleaner to the ink fountain A through the cleaner supply tube (not shown).

As shown in FIGS. 1 and 2, a pair of air cylinders 72 are disposed invertedly to the brackets 62 via supporting members 70, and a plate like dam 74 is fixed to the piston rod 72*a* of each air cylinder 72. The dam 74, as shown in FIG. 2, can be descended by operating the air cylinder 72 positively during the operation of the printing machine. The ink fountain A can be closed by bringing these dams 74 into intimate contact with the respective ends of the ink transfer roll 50 and squeezing roll 52, so that the ink or the cleaner to be supplied from the ink supply/recovery unit 54 can be retained therein (see FIG. 1). Meanwhile, when the ink is to be washed off, the dams 74 are ascended by operating the air cylinders 82 negatively to open the ink fountain A, so that the ink washing waste remaining in the ink fountain A can be discharged from the both longitudinal extremities of the ink fountain A (see FIG. 4). Incidentally, a chute 76 is disposed on each longitudinal side of the rolls 50,52 at a lower position, which is adapted to receive the ink washing waste flowing over the ink fountain A, when the dams 74 are opened, to collect it into an ink pan 78 to be described later.

A scraper 80, an elongated blade, is disposed adjacent to the squeezing roll 52 substantially on the tangential line thereof, which removes the ink from the roll 52 when the ink is to be changed in accordance with the order change. This scraper 80 is orientated against the rotational direction of the squeezing roll 52 and designed to be turned by an appropriate motor 82 to be able to approach to or spaced from the surface of the roll 52. When the roll 52 is to be washed, the swing mechanism 53 provided with respect to the ink transfer mechanism 48 is operated to shift the ink transfer roll 50 on the rotary shaft of the squeezing roll 52 counterclockwise, as shown in FIG. 4, to allow the roll 50 to be spaced from the printing die 42 and to locate at the ink removing position. Subsequently, the motor 82 is driven to bring the scraper 80 into contact with the squeezing roll 52, whereby to scrape off the ink transferred to the roll 52. The thus removed ink is recovered into the ink pan 78 disposed below the scraper 80. A duct 84 is connected to the ink pan 78, which is also connected to a washing waste tank (not shown), and the washing waste gathered into the ink pan 78 is designed to be collected to the washing waste tank provided at an appropriate position. Incidentally, it is also possible to omit the ink pan 78 and introduce the washing waste discharged to the chute 76 directly to the washing waste tank.

For the scraper 80, an iron containing metallic material or a flexible material such as rubber is suitably selected. Incidentally, if the squeezing roll 52 is of a flexible material such as rubber, it is recommended to use a material having a hardness of lower than that of the roll 52 (e.g. low-hardness rubber plate) for the scraper 80. Thus, any possible damage of the squeezing roll 52 when the ink is scraped off by the scraper 80 abutted thereto can be prevented. It should be noted here that the scraper 80 may not entirely be made of a flexible material, but, for example, a soft material may be attached at the edge of a metal scraper 80. In the scraper 80 shown in FIG. 1, while the edge thereof is orientated against the rotational direction of the roll 52, the orientation of the scraper 80 is not limited thereto. Alternatively, the scraper 80 may be orientated to the rotational direction of the roll 52 and disposed to be able to be brought into contact with the surface of the roll 52. Further, as the means for abutting the scraper 80 against the squeezing roll 52, a linear actuator such as an air cylinder can also be used.

Now, the operation of the printing machine for corrugated board sheets having the above constitution will be described. As preparatory operations, the swing mechanism 53 is actuated to shift the ink transfer roll 50 clockwise on the rotary shaft of the squeezing roll 52, whereby, as shown in FIG. 1, (1) the ink transfer roll 50 in the ink transfer mechanism 48 is brought into contact with the plate cylinder 44 (printing die 42); (2) the scraper 80 is spaced from the squeezing roll 52; (3) the dams 74 disposed on both ends of the rolls 50,52 are descended to close the respective longitudinal extremities of the ink fountain A; and (4) one opening 60*a* of the the flexible tube 60 inserted to the tubing pump 95 in the ink supply/recovery unit 54 is dipped in the ink contained in the ink pot 58, with the other opening 60*b* thereof locating above the ink fountain A.

By driving the reversible motor 96 normally in this state, the rollers 97 of the tubing pump 95 are turned clockwise to squeeze the flexible tube 60 and let the ink out through the opening 60*b*. Namely, the ink in the ink pot 58 is supplied through the flexible tube 60 to the ink fountain A defined between the ink transfer roll 50 and the squeezing roll 52, under rotation, by the continuous squeezing of the tube 60 by the rollers 97. The ink squeezed out of the opening 60*b* is retained in the ink fountain A closed by the dams 74 disposed to both longitudinal ends of the rolls 50,52.

Thus, an optimum amount of ink is adapted to be transferred via the ink transfer roll 50 onto the surface of the printing die 42 mounted on the plate cylinder 44. A predetermined pattern is printed onto corrugated board sheets 43 by feeding them successively from an upstream stocker (not shown) to the clearance between the plate cylinder 44 and the impression cylinder 46. Since the ink is of quick-drying type, the thus printed corrugated board sheets 43 can be forwarded to the subsequent step die cutter or folder gluer immediately after printing. Meanwhile, the ink is distributed evenly throughout the ink transfer roll 50 and the squeezing roll 52, so that no irregular color along the length of the rolls occurs in the printed matter. Accordingly, the operator need not constantly monitor the appearance of the printed matter.

It should be noted here that the amount of the ink dwelling in the ink fountain A to be consumed is not uniform along the axes of the rolls 50,52, but it depends on the position of the printing die 42 and the printing area. Accordingly, the drive motor 90 is actuated to slide the carriage 88 along the guide rail 86 and bring the opening 60*b* of the flexible tube 60 to the portion of the ink fountain A where the ink is consumed a lot. The ink in the ink pot 58 is then supplied through the tube 60 to the ink fountain A to supplement the desired amount of ink to the necessary portions depending on the ink consumption. Therefore, the ink consumption can be held minimum, advantageously. Further, since the ink is not circulated, the portion of the ink which used to be necessary for circulation can be omitted, so that the lot unit at the purchasing of ink can be reduced, leading to curtailment of inventory cost.

Figure 3:
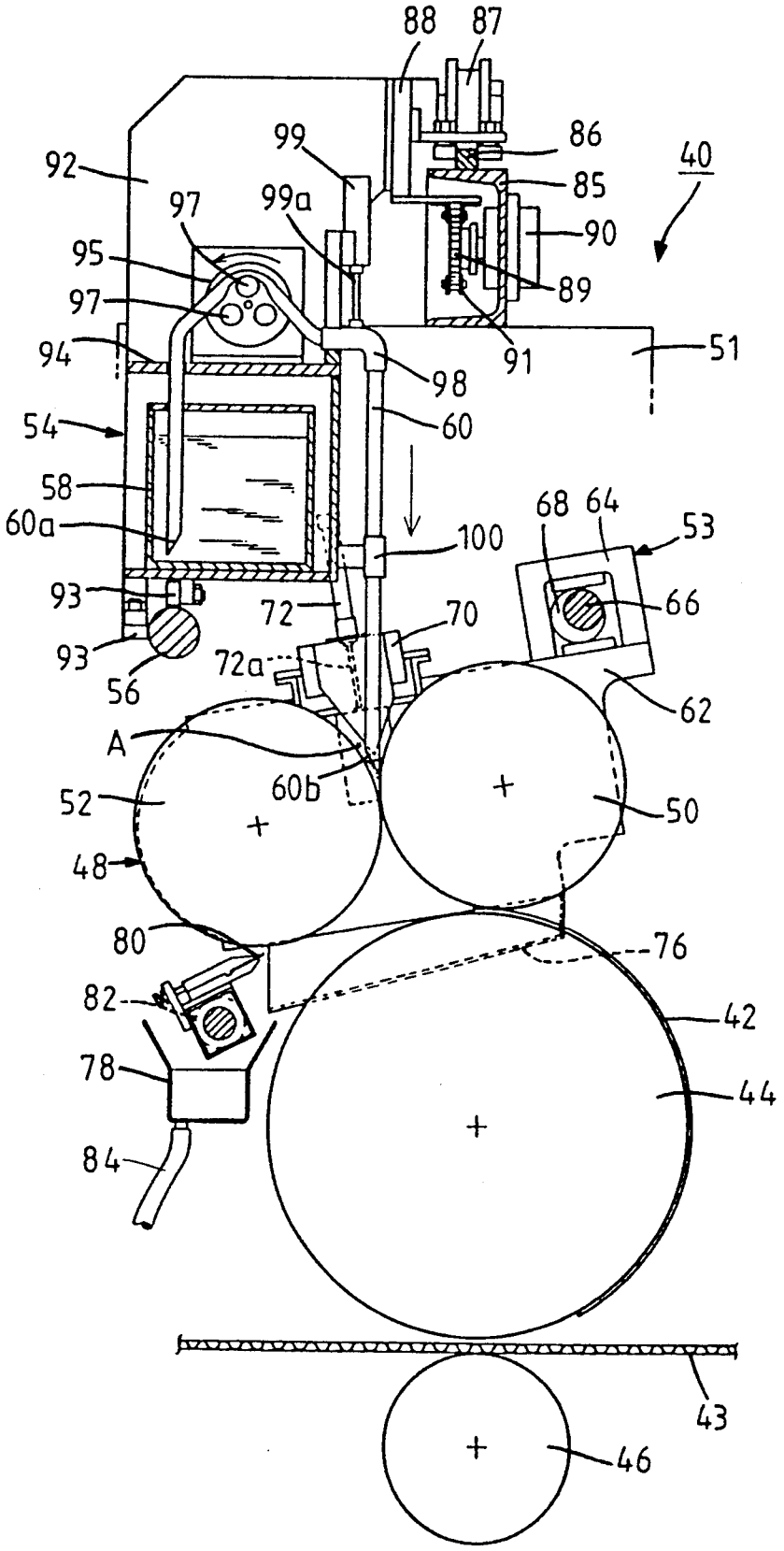
FIG. 3 shows schematically a side view of the printing machine shown in FIG. 1, illustrating a state where the ink is being recovered after completion of printing.

When the ink is to be changed in accordance with the order change, the ink is recovered and removed as follows: First, the reversible motor 96 is stopped, to interrupt supply of the ink by the flexible tube 60. The air cylinder 99 is operated to extend its rod 99*a*, when the tube 60 is descended together with the retainer 98 to dip the opening 60*b* thereof in the ink of the previous order remaining in the ink fountain A, as shown in FIG. 3. Subsequently, the reversible motor 96 is driven reversely to turn the rollers 97 of the tubing pump 95 counterclockwise, and thus the ink remaining in the ink fountain A is sucked through the flexible tube 60 and recovered to the ink pot 58. Thus, the unused ink remaining in the ink fountain 58 is prevented from being wasted and can effectively be recovered. Incidentally, if the recovery of ink is carried out while the bracket 92 is slid along the axes of the rolls 50,52, the recovery time can be reduced.

Next, the ink transfer roll 50 can be spaced from the plate cylinder 44 (printing die 42), as shown in FIG. 4, by actuating the swing mechanism 53 negatively to shift counterclockwise the ink transfer roll 50 on the rotary shaft of the squeezing roll 52, after the opening 60*b* is ascended by operating the air cylinder 99 negatively. The motor 82 is then actuated to bring the scraper 80 into contact with the squeezing roll 52 with an appropriate pressure. By idling the ink transfer roll 50 and the squeezing roll 52 at the same circumferential speed in this state, the ink adhering on the surface of the squeezing roll 52 can be scraped off by the scraper 80 and recovered into the ink pan 78.

While the greatest part of the ink remaining in the ink fountain A, which failed to be recovered by the ink supply/recovery unit 54, can be removed by the scraper 80, a very small amount of residual ink is still present in the anilox of the ink transfer roll 50. Therefore, the scraper 80 is spaced from the squeezing roll 52, and a cleaner is supplied to the ink fountain A defined between the rolls 50,52 through the cleaner supply pipe disposed to the ink supply/recovery unit 54. Since the ink fountain A is closed at the longitudinal extremities by the dams 74, the cleaner is allowed to dwell therein over the full axial length of the ink fountain A. After a cleaning operation is performed for a predetermined time, the dams 74 are ascended to open the ink fountain A, whereby the cleaner which removed the ink remaining on the ink transfer roll 50 is discharged from both extremities of the ink fountain A to the chute 76. The washing waste is further introduced from the chute 76 to the ink pan 78 and collected into the washing waste tank (not shown). Incidentally, the washing time can be reduced if the bracket 92 is moved in the axial direction of the rolls 50,52 when the cleaner is supplied to the ink fountain A.

The ink pot 58 mounted on the bracket 92 of the ink supply/recovery unit 54 is changed with another one containing a different ink therein in accordance with the new order, and the flexible tube 60 is detached from the tubing pump 95. After the flexible tube 60 is washed outside of the machine, it is inserted again to the tubing pump 95 to allow one opening 60*a* thereof to be dipped in the ink contained in the ink pot 58, while the other opening 60*b* thereof to locate above the ink fountain A, to complete ink change operations. Incidentally, since the ink pot 58 locates adjacent to the ink fountain A, a short flexible tube 60 can be used, so that the amount of the residual ink in the tube 60 can be reduced. Further, since the tubing pump 95 itself need not be washed, loss of the ink can be minimized. Meanwhile, the change-over time can further be reduced by providing spare flexible tubes preliminarily washed for order changes, since the tube need not be washed at the time of order change.

Since the ink remaining in the ink fountain A can be recovered as described above in order to carry out ink change in accordance with the order change, the amount of the ink to be wasted can be minimized, economizing the ink consumption. Since most of the ink remaining on the roll 50 can be removed by the scraper 80, the residual ink adhering on the ink transfer roll 50 after scraping can securely be removed by using a very small amount of cleaner. The change-over operations in accordance with the order change can be completed in a short time to be able to cope with small lot printing depending on various types of orders, since the pump and the ink circulating system need not be washed by the use of spare flexible tubes. Meanwhile, when the newly developed ink is used, the amount of the cleaner to be used for washing the rolls can be reduced to about 200 cc as opposed to about 60 l in the conventional flexographic printer, so that the amount of the washing waste can extremely be minimized, contributing tremendously to pollution prevention.

Incidentally, referring to the washing off of the ink, the following methods are also possible in addition to the one described above.

(1) After the washing waste is collected, the scraper 80 is abutted again against the squeezing roll 52 to remove the moisture remaining on the roll 52;

(2) After the ink on the squeezing roll 52 is scraped off by the scraper 80, the cleaner is supplied to the ink fountain A, defined between the ink transfer roll 50 and the squeezing roll 52, with the scraper 80 being abutted against the roll 52 to carry out cleaning; or (3) After the ink on the squeezing roll 52 is scraped off by the scraper 80, the scraper 80 is spaced from the roll 52 once until the cleaner is fully distributed evenly throughout the rolls, and then the scraper 80 is abutted again against the squeezing roll 52 to remove and collect the washing waste into the ink pan 78. In the cases of (2) and (3), since the greatest part of the ink remaining on the ink transfer roll 50 can be removed by the scraper 80, the amount of the cleaner to be supplied to the ink fountain A defined between the rolls 50,52 can extremely be minimized.

Figure 5:
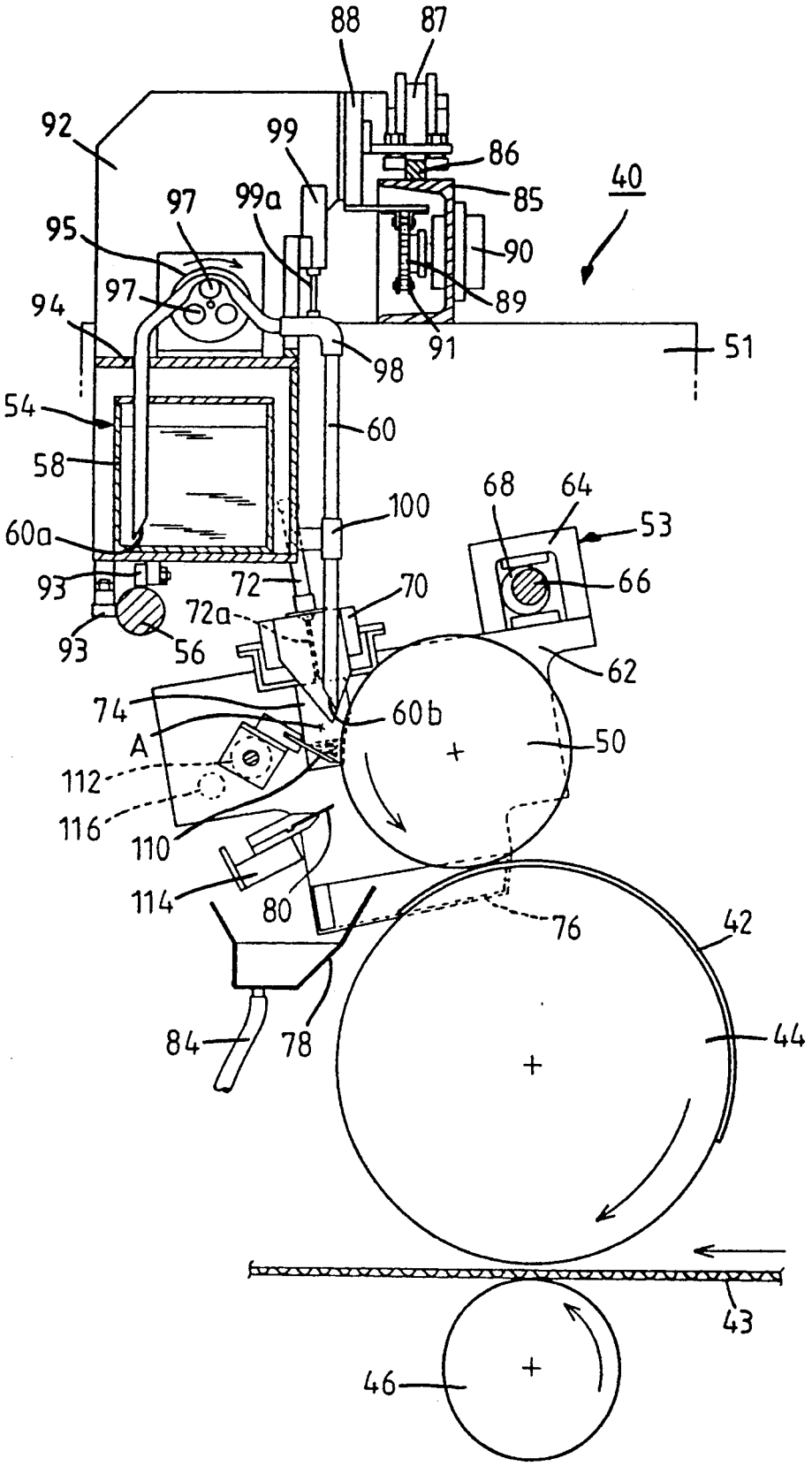
FIG. 5 shows schematically a side view of the printing machine according to a second embodiment of the invention, illustrating a state where printing is being carried out onto a corrugated board sheet.

FIG. 5 shows the printing machine according to the second embodiment of the invention, in which the basic constitution of the plate cylinder 44, impression cylinder 46 and the ink supply/recovery unit 54 is the same as the one described referring to FIGS. 1 to 4, except for the difference in the mechanism of adjusting the amount of the ink to be supplied to the ink transfer roll 50 in the mechanism 48 of transferring the ink to the printing die 42. Namely, an elongated adjust plate 110 is disposed to the brackets 62 on which the ink transfer roll 50 is rotatably supported and orientated to the rotational direction of the ink transfer roll 50 with its edge directing along the tangential line of the roll 50. The adjust plate 110 is connected to a motor 112, so that the clearance between the edge of the plate 110 and the roll surface can freely be adjusted by driving the motor 112 normally or reversely whereby to adjust the amount of the ink on the surface of the ink transfer roll 50. Alternatively, the clearance between the adjust plate 110 and the ink transfer roll 50 may be adjusted by a linear actuator such as an air cylinder instead of the motor 112.

An ink fountain A is defined above the ink transfer roll 50 and the adjust plate 110 along the longitudinal directions of these two members, and the both longitudinal extremities of the ink fountain A are designed to be selectively opened or closed by the dams 74. Incidentally, the opening and closing of the longitudinal extremities of the ink fountain A may be designed to be performed by air curtain. For example, a pair of air blow pipes connected to an air supply source are disposed at positions above and adjacent to the both extremities of the ink fountain A to blow air therefrom against the ink fountain A to check flowing out of the ink from the ink fountain A during operation of the printing machine. Meanwhile, in order to carry out ink change in accordance with the order change, the air blowing from the air blow pipes is interrupted to allow the residual ink or washing waste in the ink fountain A to be discharged from the extremities to the chute 76.

Figure 6:
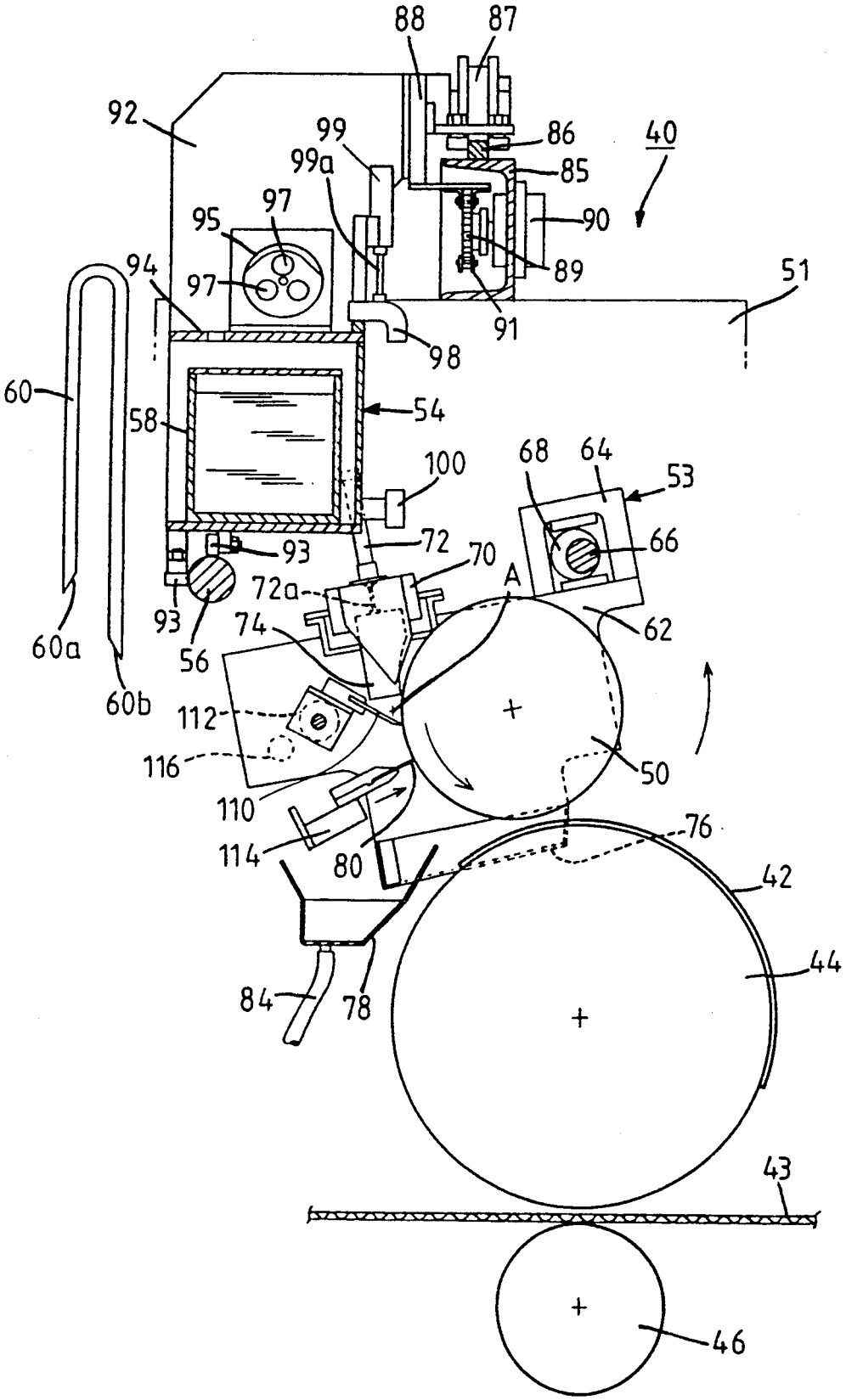
FIG. 6 shows schematically a side view of the printing machine shown in FIG. 5, illustrating a state where the residual ink in the printing machine is being washed away after completion of printing.
Figure 7:
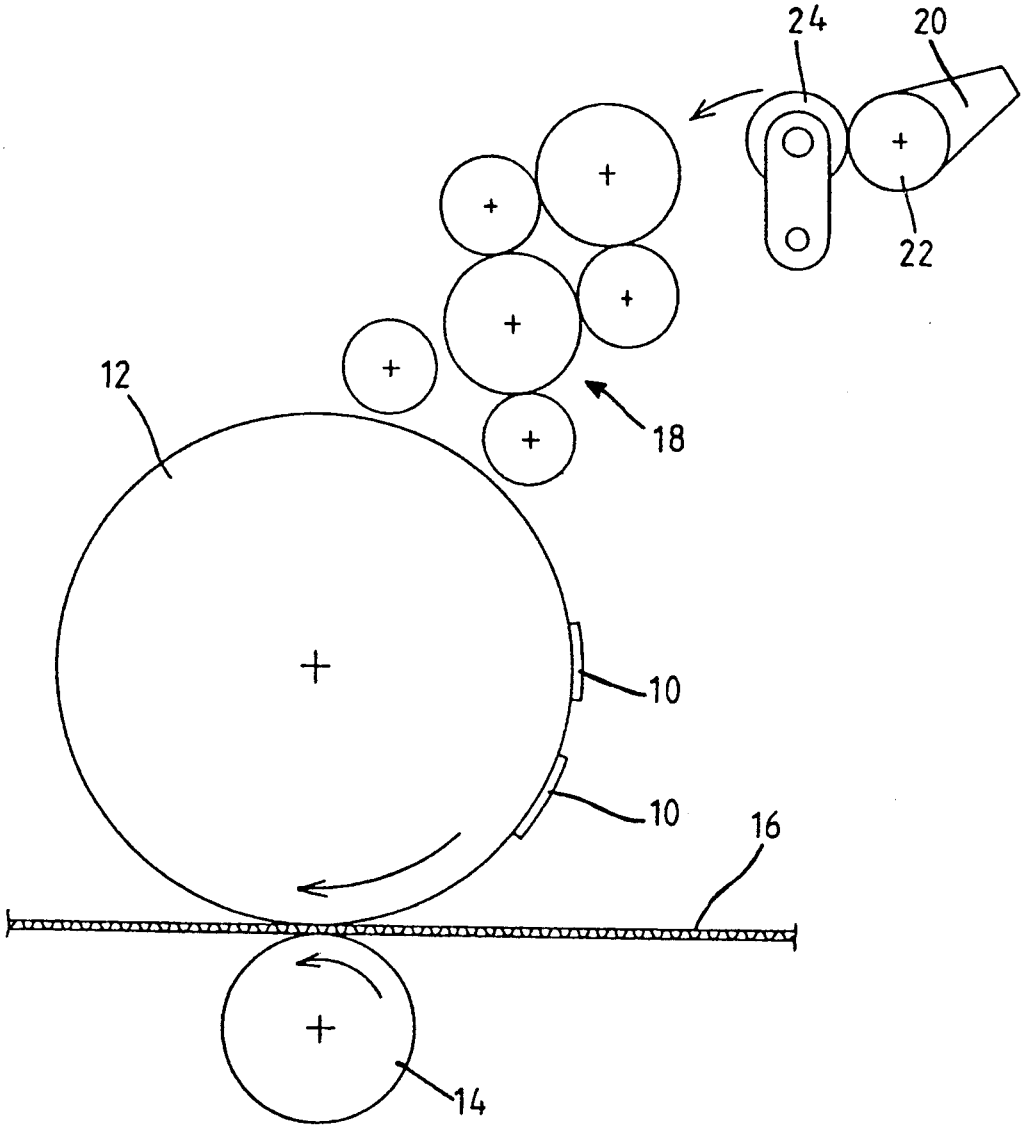
FIG. 7 PRIOR ART
FIG. 7 shows schematically in side view an arrangement of various rolls in a prior art printer slotter.
Figure 8:
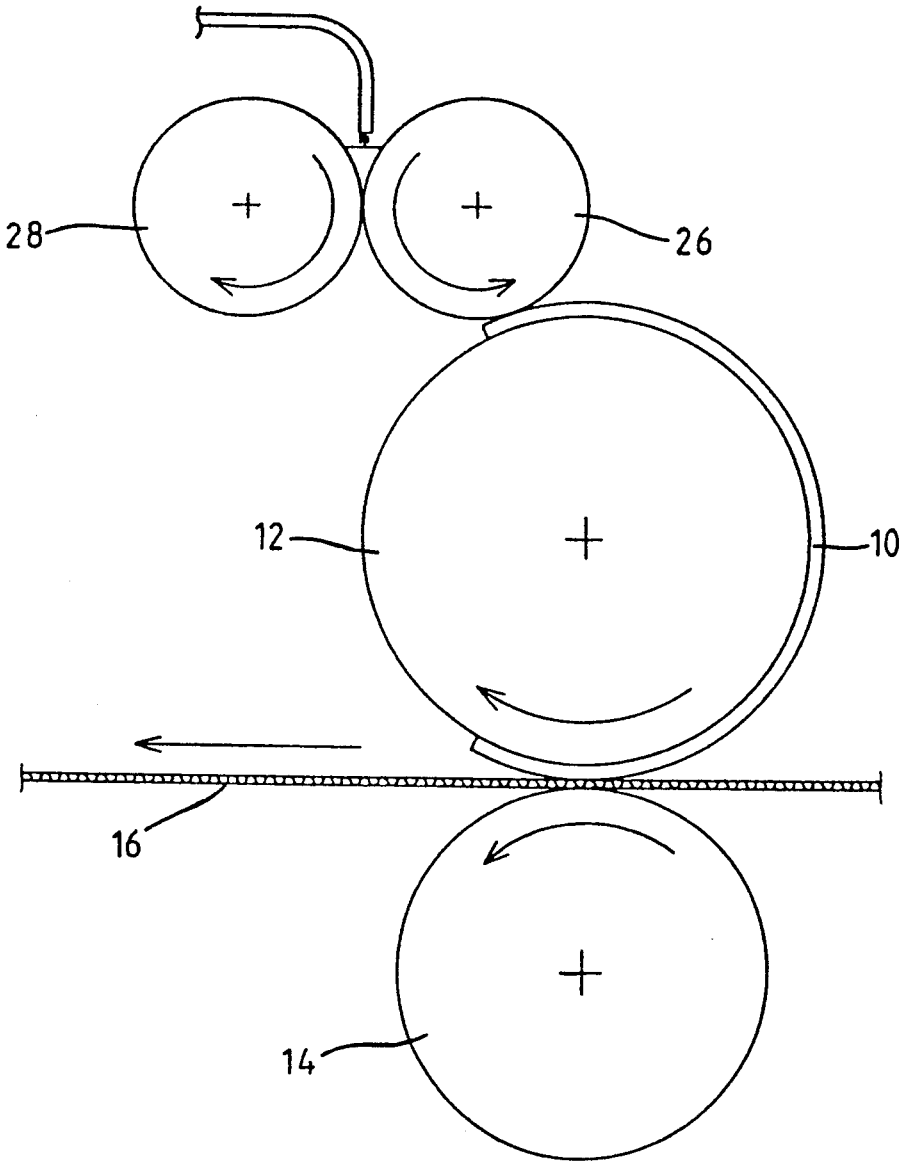
FIG. 8 PRIOR ART
FIG. 8 shows schematically in side view an arrangement of various rolls in a prior art flexographic press.
Figure 9:
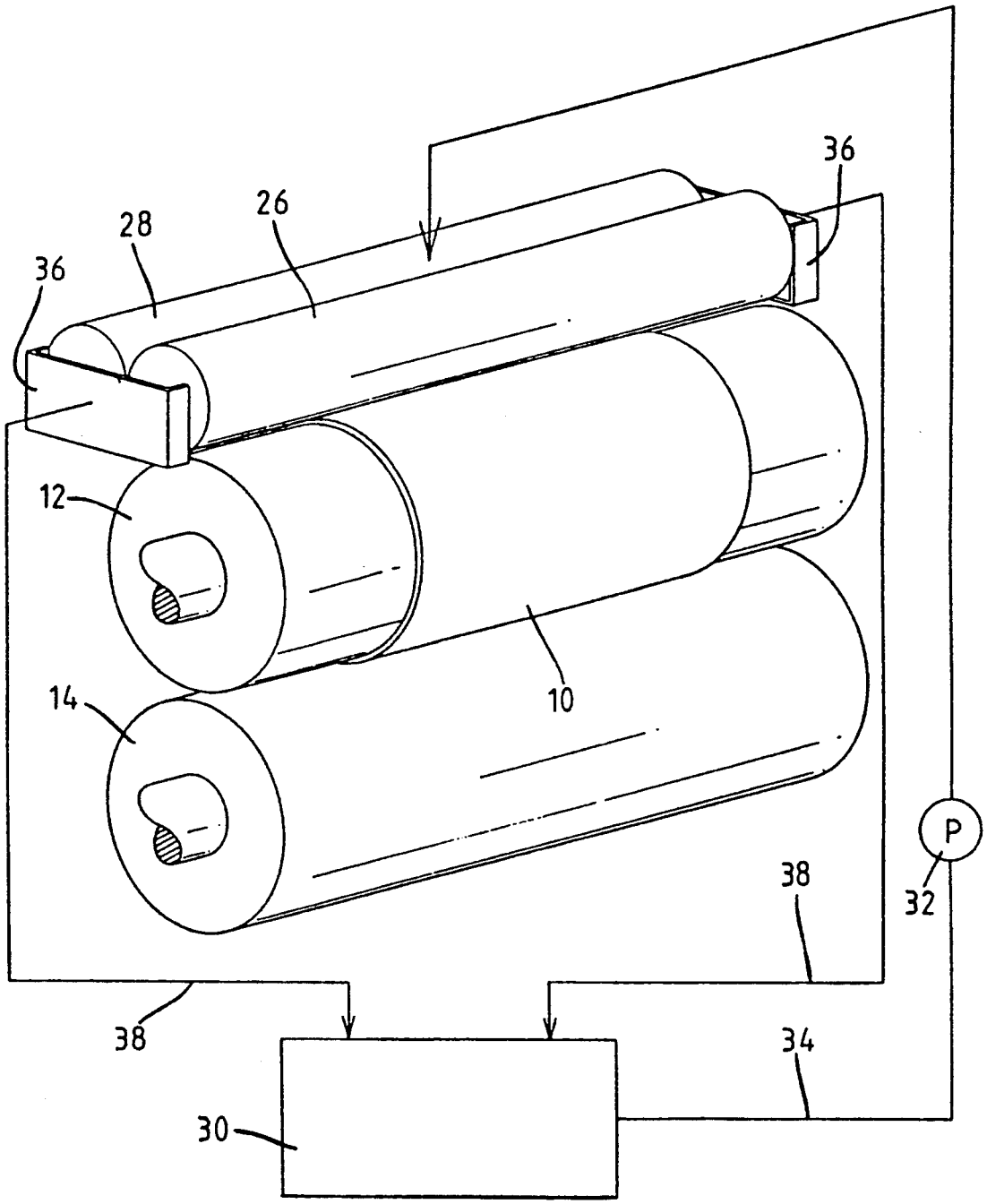
FIG. 9 PRIOR ART
FIG. 9 shows schematically in perspective view the mechanism of the ink circulating/supply system in the flexographic press shown in FIG. 8.

A blade-like scraper 80 is disposed adjacent to the ink transfer roll 50, which is connected to a fluid pressure cylinder 114 so as to be able to be abutted against the surface of the roll 50. The ink transferred to the roll 50 can be removed by the scraper 80 abutted against the ink transfer roll 50, as shown in FIG. 6. The thus removed ink is designed to be recovered into the ink pan 78 disposed below the scraper 80. The drive source for the scraper 80 may be a motor like in the embodiment shown in FIG. 1.

Incidentally, the swing mechanism 53 for shifting the ink transfer roll 50 between (1)- the ink transferring position, where the ink transfer roll 50 is brought into contact with the printing die 42 to allow the ink to be transferred to the printing die 42 and (2) the ink removing position, where the ink transfer roll 50 is spaced from the printing die 42 to be unable to transfer the ink to the printing die 42 is basically the same as in the embodiment shown in FIG. 1, except that the brackets 62 are pivotally supported via a pair of pins 116 protruding outward therefrom onto the machine frames 52. Thus, the brackets 62 are pivoted on the pins 116 by rotating the change-over shaft 66 to allow the ink transfer roll 50 to be shifted between the ink transferring position (FIG. 5) and the ink removing position (FIG. 6).

Next, the operation of the printing machine for corrugated board sheet according to the second embodiment of the invention will be described. As preparatory operations, as shown in FIG. 5, (1) the ink transfer roll 50 is brought into contact with the plate cylinder 44 (printing die 42); (2) the scraper 80 is spaced from the ink transfer roll 50; (3) the clearance between the edge of the adjust plate 110 and the surface of the ink transfer roll 50 is adjusted to an appropriate level by urging the motor 112; and (4) the dams 74 are descended to close both longitudinal extremities of the ink fountain A. The ink is supplied to the ink fountain A defined between the adjust plate 110 and the rotating ink transfer roll 50 through the flexible tube 60 extending from the tubing pump 95 and retained therein as closed by the dams 74.

As described above, an optimum amount of ink is adapted to be transferred via the ink transfer roll 50 onto the surface of the printing die 42 mounted on the plate cylinder 44. A predetermined pattern is printed onto corrugated board sheets 43 by feeding them successively from an upstream stocker (not shown) to the clearance between the plate cylinder 44 and the impression cylinder 46. Since the ink is of quick-drying type, the thus printed corrugated board sheets 43 can be forwarded to the subsequent step die cutter or folder gluer immediately after printing. Meanwhile, the ink is distributed evenly throughout the ink transfer roll 50 and the adjust plate 110, no irregular color along the length of the roll occurs in the printed matter. Accordingly, the operator need not constantly monitor the appearance of the printed matter.

When the ink is to be changed in accordance with the order change, the ink is removed as follows: First, the supply of ink from the flexible tube 60 extended from the tubing pump 95 is interrupted. The tube 60 is descended to dip the opening 60*b* thereof in the ink remaining in the ink fountain A, and the tubing pump 95 is driven reversely in this state to recover the ink remaining in the ink fountain A into the ink pot 58.

Next, the swing mechanism 53 is actuated negatively, after the flexible tube 60 is ascended, to shift the ink transfer roll 50 counterclockwise on the pins 116, and thus the ink transfer roll 50 can be spaced from the plate cylinder 44 (printing die 42), as shown in FIG. 6. The fluid pressure cylinder 114 is operated to allow the scraper 80 to be abutted against the ink transfer roll 50 with an optimum pressure. Subsequently, the adjust plate 110 is spaced from the ink transfer roll 50. Thus, the greatest part of the ink remaining in the ink fountain A which failed to be recovered by the flexible tube 60 adheres onto the ink transfer roll 50, which can then be scraped off by the scraper 80 and recovered into the ink pan 78.

Next, the scraper 80 is spaced from the ink transfer roll 50, and the adjust plate 110 is brought into contact with the roll 50. A cleaner is supplied to the ink fountain A through the cleaner supply pipe disposed to the ink supply/recovery unit 54. Since the ink fountain A is closed at both longitudinal extremities by the dams 74, the cleaner can be retained therein to be distributed throughout the length of the rolls 50. After a cleaning operation is performed in this state for a predetermined time, the dams 74 are ascended to open the ink fountain A, whereby the cleaner which removed the ink remaining on the ink transfer roll 50 is discharged from both extremities of the ink fountain A to the chute 76. The washing waste is further introduced from the chute 76 to the ink pan 78 and then collected into the washing waste tank (not shown). The ink pot 58 mounted in the ink supply/recovery unit 54 is changed with another one containing different ink therein, and the flexible tube 60 is detached from the tubing pump 95 and washed or is replaced with a spare tube 60, to complete ink change operations.

Incidentally, referring to the washing off of the ink, the following methods are also possible.

(1) After the washing waste is collected, the moisture remaining on the ink transfer roll 50 is removed by the scraper 80; or (2) After the ink on the ink transfer roll 50 is scraped off by the scraper 80, the cleaner is supplied to the ink fountain A with the scraper 80 being abutted against the roll 50 to carry out washing. The other method described referring to the embodiment shown in FIG. 1 may of course suitably be employed.

While the washing waste discharged to the chute is designed to be collected to the washing waste tank through the ink pan in the above embodiments, the present invention is not limited thereto, but it is also possible to introduce the washing waste discharged to the chute directly to the washing waste tank. On the other hand, the number of the ink supply/recovery unit which selectively performs supply and recovery of the ink is not limited to only one, but a plurality of such units can serially be disposed. In this case, the ink can speedily be supplemented to necessary portions of the ink fountain, since each of the unit may be moved within a narrower stroke. Further, while supply and recovery of the ink is carried out using a tubing pump in the above embodiments, the present invention is not limited thereto, but any other types of pumps so long as they can be urged positively and negatively can also be used.

Although some embodiments of the present invention have been described herein, it should be apparent to those skilled in the art that the present invention may be embodied in many other specific forms without departing from the spirit or scope of the invention.

What is claimed is:

1. A printing machine for corrugated board sheets having a plate cylinder with a printing die mounted thereon and an impression cylinder disposed to oppose to said plate cylinder, rotatable in the different rotational directions, in which corrugated board sheets are designed to pass through the clearance between said plate cylinder and said impression cylinder to carry out printing in a predetermined pattern, said printing machine further comprising:

an ink transfer roll disposed to be approachable to said plate cylinder, which rotates in contact with said printing die mounted on said plate cylinder when it is approached to said plate cylinder;

a squeezing roll which rotates normally in contact with said ink transfer roll during operation of the printing machine to squeeze the ink and adjust the amount of the ink on the surface of said ink transfer roll;

a supply unit disposed above said ink transfer roll and squeezing roll to selectively supply a low-viscosity and highly quick-drying ink or a cleaner to the ink fountain defined between said rolls;

a pair of dams disposed engageably with both longitudinal ends of said ink transfer roll and squeezing roll so as to selectively open and close the both longitudinal extremities of the ink fountain; and a scraper disposed engageably with respect to said squeezing roll, which scrapes off the ink or the ink washing waste transferred to said roll when said scraper is brought into contact therewith.

2. The printing machine for corrugated board sheets according to claim 1, wherein said squeezing roll is made of a soft rubbery material, and at least the portion thereof to be abutted against said roll is of a material having a lower hardness than that of said roll.

3. The printing machine for corrugated board sheets according to claim 1 or 2, wherein said scraper is orientated against the rotational direction of said squeezing roll.

4. The printing machine for corrugated board sheets according to claim 1 or 2, wherein said scraper is orientated to the rotational direction of said squeezing roll.

5. The printing machine for corrugated board sheets according to claim 1 or 2, which has an ink pan for recovering the ink removed by said scraper disposed below said scraper, and a chute, disposed below said ink transfer roll and squeezing roll adjacent to the respective longitudinal end portions thereof, for receiving the ink washing waste overflowing from the ink fountain when the dams are opened, wherein said chute is open to said ink pan.

6. A printing machine for corrugated board sheets having a plate cylinder with a printing die mounted thereon and an impression cylinder disposed to oppose to said plate cylinder, rotatable in the different rotational directions, in which corrugated board sheets are designed to pass through the clearance between said plate cylinder and said impression cylinder to carry out printing in a predetermined pattern, said printing machine further comprising:

an ink transfer roll disposed to be approachable to said plate cylinder, which rotates in contact with said printing die mounted on said plate cylinder when it is approached to said plate cylinder;

an adjust member disposed adjacent to said ink transfer roll to adjust the amount of the ink on the surface of said ink transfer roll;

a supply unit disposed above said ink transfer roll and adjust member to selectively supply a low-viscosity and highly quick-drying ink or a cleaner to the ink fountain defined between said roll and said adjust member; and a pair of regulating means disposed adjacent to both longitudinal ends of said ink transfer roll and adjust means so as to selectively regulate discharge of said ink or washing waste from the longitudinal extremities of the ink fountain and release such regulation thereby.

7. A printing machine for corrugated board sheets having a plate cylinder with a printing die mounted thereon and an impression cylinder disposed to oppose to said plate cylinder, rotatable in the different rotational directions, in which corrugated board sheets are designed to pass through the clearance between said plate cylinder and said impression cylinder to carry out printing in a predetermined pattern, said printing machine further comprising:

an ink transfer roll disposed to be approachable to said plate cylinder, which rotates in contact with said printing die mounted on said plate cylinder when it is approached to said plate cylinder;

a squeezing roll which rotates normally in contact with said ink transfer roll during operation of the printing machine to squeeze the ink and adjust the amount of the ink on the surface of said ink transfer roll;

a supply/recovery unit disposed above said ink transfer roll and squeezing roll to be slidable parallel to said rolls , which selectively supplies a low-viscosity and highly quick-drying ink to the ink fountain defined between said rolls and recovers the residual ink in said ink fountain; and a pair of dams disposed engageably with both longitudinal ends of said ink transfer roll and squeezing roll so as to selectively open and close the both longitudinal extremities of the ink fountain.

8. The printing machine for corrugated board sheets according to claim 7, wherein said supply/recovery unit has a tubing pump which can be urged positively and negatively by a reversible motor and a flexible tube detachably inserted to said tubing pump;

wherein one opening of said flexible tube is dipped in the ink contained in an ink pot, while the other opening is locating above the ink fountain, to supply the ink in the ink pot to the ink fountain by actuating said reversible motor and to recover the residual ink in the ink fountain into said ink pot by actuating said motor reversely.

9. A printing machine for corrugated board sheets having a plate cylinder with a printing die mounted thereon and an impression cylinder disposed to oppose to said plate cylinder, rotatable in the different rotational directions, in which corrugated board sheets are designed to pass through the clearance between said plate cylinder and said impression cylinder to carry out printing in a predetermined pattern, said printing machine further comprising:

an ink transfer roll disposed to be approachable to said plate cylinder, which rotates in contact with said printing die mounted on said plate cylinder when it is approached to said plate cylinder;

a squeezing roll which rotates normally in contact with said ink transfer roll during operation of the printing machine to squeeze the ink and adjust the amount of the ink on the surface of said ink transfer roll;

a supply unit disposed above said ink transfer roll and squeezing roll to supply a low-viscosity and highly quick-drying ink to the ink fountain defined between said rolls; and a pair of regulating means disposed adjacent to both longitudinal ends of said ink transfer roll and squeezing roll so as to selectively regulate discharge of said ink from the longitudinal extremities of the ink fountain and release such regulation thereby.

10. The printing machine for corrugated board sheets according to claim 9, wherein said regulating means consists of a pair of dams disposed engageably about both longitudinal ends of said ink transfer roll and squeezing roll so as to selectively open and close the both longitudinal extremities of the ink fountain.

* * * * *